US009850607B2

(12) United States Patent
Jones et al.

(10) Patent No.: US 9,850,607 B2
(45) Date of Patent: Dec. 26, 2017

(54) BALANCING YARN USE IN DESIGNING TUFTED PATTERNS FOR TEXTILES

(71) Applicant: Interface, Inc., Atlanta, GA (US)

(72) Inventors: William Nathan Jones, West Point, GA (US); Jorge Del Angel, LaGrange, GA (US); Graeme Robert Ripley, LaGrange, GA (US)

(73) Assignee: Interface, Inc., Atlanta, GA (US)

( * ) Notice: Subject to any disclaimer, the term of this patent is extended or adjusted under 35 U.S.C. 154(b) by 0 days.

(21) Appl. No.: 15/405,351

(22) Filed: Jan. 13, 2017

(65) Prior Publication Data

US 2017/0260668 A1 Sep. 14, 2017

Related U.S. Application Data

(60) Provisional application No. 62/305,845, filed on Mar. 9, 2016.

(51) Int. Cl.
*D05C 5/02* (2006.01)
*D05B 19/12* (2006.01)
(Continued)

(52) U.S. Cl.
CPC ..... *D05B 19/12* (2013.01); *D05C 5/00* (2013.01); *D05C 15/00* (2013.01)

(58) Field of Classification Search
CPC ..... D05B 19/02; D05B 19/04; D05B 19/10; D05B 19/12; D05C 5/00; D05C 5/02;
(Continued)

(56) References Cited

U.S. PATENT DOCUMENTS 5,058,518 A * 10/1991 Card ..... D05C 15/26 112/410
6,244,203 B1 * 6/2001 Morgante ..... D05C 15/18 112/475.23
(Continued)

FOREIGN PATENT DOCUMENTS

EP 2077348 7/2009
GB 2319786 6/1998
(Continued)

OTHER PUBLICATIONS

PCT/US2017/014811, "International Search Report and Written Opinion", dated May 19, 2017, 11 pages.

*Primary Examiner* — Nathan Durham
(74) *Attorney, Agent, or Firm* — Kilpatrick Townsend & Stockton LLP

(57) ABSTRACT

Tools are provided that communicate to a pattern designer how much yarn is being used on every needle for a given tuft height pattern and permit the designer to adjust the pattern accordingly to balance the yarn usage on the needles. An electronic representation of a pattern design is received for controlling a carpet tufting operation. The pattern design includes a pile height per tuft. A grid is provided for representing the pattern design using different visual cues to represent different pile heights. A graph depicting use-of-yarn per needle for the carpet tufting operation is generated. The grid and the graph are on a common user interface and are viewable at the same time on a display device.

20 Claims, 4 Drawing Sheets

(51) Int. Cl.
*D05C 15/00* (2006.01)
*D05C 5/00* (2006.01)

(58) Field of Classification Search
CPC ..... D05C 15/00; D05C 15/04; D05C 15/08; D05C 15/26; D05C 15/32
USPC ..... 700/136–138
See application file for complete search history.

(56) References Cited

U.S. PATENT DOCUMENTS

| | | | | |
|---|---|---|---|---|
| 8,141,505 | B2 * | 3/2012 | Hall | D05C 15/26 112/80.23 |
| 8,155,776 | B2 * | 4/2012 | Bittner | A47G 27/0275 700/131 |
| 8,347,800 | B1 | 1/2013 | Machell-Archer et al. | |
| 8,430,043 | B2 * | 4/2013 | Vaughan | D05C 15/18 112/475.08 |
| 2003/0164130 | A1 * | 9/2003 | Morgante | D05C 15/18 112/475.23 |
| 2006/0149409 | A1 * | 7/2006 | Dabrowa | D05C 15/34 700/137 |
| 2007/0146140 | A1 | 6/2007 | Nagao et al. | |
| 2007/0272137 | A1 | 11/2007 | Christman et al. | |
| 2009/0205547 | A1 | 8/2009 | Hall et al. | |
| 2009/0260554 | A1 | 10/2009 | Hall et al. | |

FOREIGN PATENT DOCUMENTS

| | | |
|---|---|---|
| JP | 2005240199 | 9/2005 |
| WO | 2007146140 | 12/2007 |

* cited by examiner

BALANCING YARN USE IN DESIGNING TUFTED PATTERNS FOR TEXTILES

CROSS-REFERENCE TO RELATED APPLICATIONS

This claims priority under 35 U.S.C. §119 to U.S. Provisional Application Ser. No. 62/305,845, filed Mar. 9, 2016 and titled "Tools for Designing Tufted Patterns with Balanced Yarn Use," the entirety of which is incorporated herein by reference.

TECHNICAL FIELD

The present disclosure relates generally to manufacturing and designing carpet and other types of textiles. More specifically, but not by way of limitation, this disclosure relates to designing patterns for carpet and other textiles to manage yarn use during manufacturing.

BACKGROUND

Carpet is typically formed by tufting a face cloth. In the case of carpet tiles, the face cloth may be attached to a stabilizing structural backing to form a carpet web that is then cut into carpet tiles of the desired shape and size.

Designs, patterns, or color is imparted to the face cloth via a tufting operation. A tufting machine can include at least one needle bar with needles arranged across the bar. A colored yarn can be associated with each needle. A backing material is fed under the needle bar, which is reciprocated to drive the needles through and out of the backing material to form loops of yarn or "tufts" in the backing material. As this process continues, the tufts extend across the backing material in generally lateral rows and down the backing material in generally longitudinal columns to form the face cloth.

To impart designs on the face of the face cloth, the needle bar carrying the yarn-bearing needles is capable of limited lateral movement relative to the backing material that can shift the placement of tufts laterally across the backing material. The yarn fed to the needles can also be controlled to vary the height of the tufts placed in the backing. Moreover, both the rate at which the backing material moves relative to the needle bar as well as the rate at which the needle bar creates tufts in the backing material can be controlled to manage the density of the tufts in the face cloth.

In some tufting machines, multiple needle bars are used to enhance opportunities to create designs. Without these capabilities, the resulting product includes tufts extending in lines of a single color along the length of the backing material. To form a non-striped pattern with the tufts, the needle bar shifts laterally to vary the positioning of the different color tufts in the backing material and to vary the height of the tufts to form the desired design or pattern. U.S. Pat. No. 8,347,800 to Carson-Machell et al. and U.S. Patent Publication No. 2009/0205547 to Hall et al. disclose various tufting methodologies.

During the tufting process, yarn is continually fed to each needle on the needle bar. Prior to tufting, yarn of the desired color is wound onto a yarn package. A yarn package is prepared for each tufting needle. The yarn packages are then loaded on a creel and each yarn end associated with the intended needle on the needle bar. During use and as tufting proceeds, the yarn unwinds from the packages.

It is difficult to gauge how much yarn each needle will need in order to create the desired pattern. Moreover, if a single yarn package is depleted during tufting, the entire tufting process must be stopped and the yarn package replaced before tufting can resume. Such a process is extremely time- and labor-intensive and expensive.

To avoid yarn packages from running out during tufting, the yarn packages are typically over-prepared, meaning that more yarn than will be necessary is provided on the package. Depending on the complexity of the pattern and diversity of yarn color used to create it, some yarn packages are over-prepared by as much as 85% to 100%. Moreover, the unused yarn remaining on the yarn packages after tufting must be spliced and repackaged. Yarn can only be wound onto and unwound from yarn packages so many times before it becomes unusable.

SUMMARY

In one example, a method is provided. An electronic representation of a pattern design is received for controlling a carpet tufting operation. The pattern design includes a pile height per tuft. A grid is provided for representing the pattern design using different visual cues to represent different pile heights. A graph depicting use-of-yarn per needle for the carpet tufting operation is generated by a processor executing a pattern design engine. The grid and the graph are on a common user interface and are viewable at the same time on a display device. The graph is modified to illustrate a new use-of-yarn per needle that accounts for the change in response to receiving a change to a pile height of one or more tufts for the pattern design on the grid.

In another example, a non-transitory, computer-readable medium is provided that has program instructions that are executable by a processor for performing operations. The operations include:

- receiving an electronic representation of a pattern design for controlling a carpet tufting operation, the pattern design including a pile height per tuft;
- providing a grid for representing the pattern design using different visual cues to represent different pile heights;
- generating a graph depicting use-of-yarn per needle for the carpet tufting operation, the grid and the graph being on a common user interface and viewable at the same time on a display device; and
- responsive to receiving a change to a pile height of one or more tufts for the pattern design on the grid, modifying the graph to illustrate a new use-of-yarn per needle that accounts for the change.

In another example, a system is provided that includes a display device and a computing device communicatively coupled to the display device. The display device can output a common user interface. The computing device includes a processor and a non-transitory, computer-readable memory having instructions that are executable by the processor to cause the computing device to perform operations. The operations include:

- receiving an electronic representation of a pattern design for controlling a carpet tufting operation, the pattern design including a pile height per tuft;
- providing a grid for representing the pattern design using different visual cues to represent different pile heights;
- generating a graph depicting use-of-yarn per needle for the carpet tufting operation and outputting the grid and the graph for display by the display device on the common user interface such that the grid and the graph are viewable at the same time on the display device; and responsive to receiving a change to a pile height of one or more tufts for the pattern design on the grid, modifying the graph to illustrate a new use-of-yarn per needle that accounts for the change.

DETAILED DESCRIPTION

Figure 1:
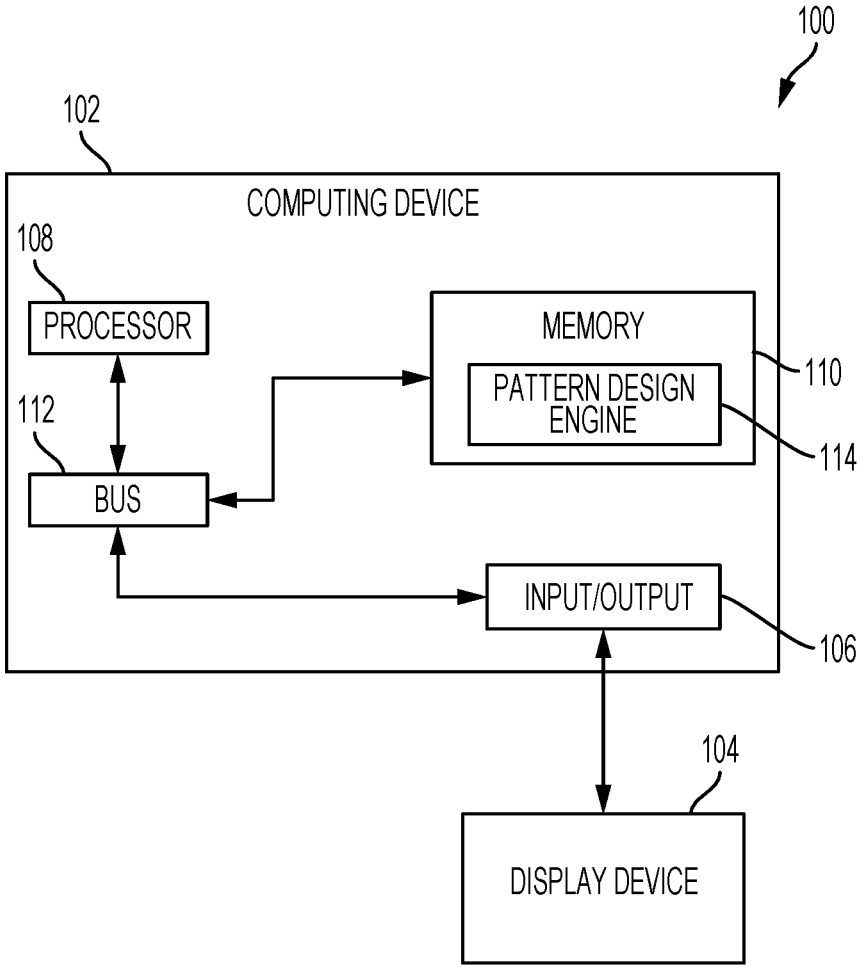
FIG. 1 is a block diagram of a computing system for facilitating even take-up carpet design according to some examples of the present disclosure.

Certain aspects and features relate to tools for pattern designers that communicate to the designer during the design process how much yarn is being used on every needle for a given pattern and permit the designer to adjust the pattern accordingly to balance the yarn usage on the needles. By way of example only, the tool can graphically represent the yarn use for each needle and display, in real time, changes in yarn usage based on changes that the designer makes to the pattern. In other embodiments, the tool can automatically alter the design to affect more balanced yarn usage in ways that do no harm to the design intent.

In an ideal world, all of the yarns would have the same yarn usage such that all of the yarn packages at the end of a tufting run would be empty. This result would simplify yarn package preparation (all of the packages would be prepared with the same amount of yarn) as well as eliminate the need to process (e.g., splice and re-package) any residual yarn after tufting is complete.

Perhaps less preferable but still advantageous would be designing patterns such that the same color of yarn has the same usage. For example, all of the blue yarn packages would be identical to all of the other blue yarn packages; all of the yellow yarn packages would be identical to all of the other yellow yarn packages, etc. Again, this would simplify the yarn package preparation process with the goal being to have an empty creel at the end of every run.

Advance knowledge of exactly how much yarn will be needed for each needle for a given tufting pattern can result in material savings (there is no need to over-prepare the yarn packages so one can purchase and keep less yarn in inventory), labor savings (less labor involved in preparing yarn packages), and time savings (less tufting shutdowns caused by yarn package depletion).

A system according to some examples can receive pile (or tuft) heights, stitch rates, and pattern repeats for a particular carpet design. Different colors on a user interface can represent different pile heights—a pile height value can be assigned to each color. A real-time graph can represent use-of-yarn per needle changes substantially contemporaneously to changes in the tuft height design. The real-time graph can be on the same user interface as the visual representation of the tuft height design.

For example, a pattern design for controlling a carpet tufting operation can be received in electronic form. The pattern design can include a pile height per tuft illustrated by colors or other visual representation cue. A grid can represent the tuft height pattern design with the visual cues. A graph can be included on the same user interface as the grid. The graph can represent the use-of-yarn per needle for the carpet tufting operation and a threshold that indicates a desired yarn-use across multiple needles for the carpet tufting operation. In response to receiving a change to a pile height of one or more tufts for the pattern design on the grid, the graph can be modified to illustrate a new use-of-yarn per needle that accounts for the change.

In some examples, the pile height values can be modified or an acceptable range for a pile height of a certain value can be established. For example, the value may correspond to 5 millimeters (mm) and an acceptable range of tuft heights for that value can be 4 mm to 6 mm. The system may be able to select an exact value within the range for each stitch so that the use-of-yarn per needle does not deviate beyond the threshold. In other examples, the system can receive values per stitch within the range from a user and, in real time, display changes to yarn use per needle. The system may establish a buffer limit on the number of pile height values that are near the end of a range that is within a certain amount of another pile height value. On the user interface, different shades of the same color may visually represent variations in pile heights of the same value.

These illustrative examples are given to introduce the reader to the general subject matter discussed here and are not intended to limit the scope of the disclosed concepts. The following sections describe various additional features and examples with reference to the drawings in which like numerals indicate like elements, and descriptions of order are used to describe the illustrative aspects but, like the illustrative aspects, should not be used to limit the present disclosure.

FIG. 1 is a block diagram of an example of a computing system 100 for facilitating even take-up carpet design according to some aspects. The computing system 100 includes a computing device 102 and a display device 104 that can receive and display information from the computing device 102 through an input/output 106 in the computing device 102.

Examples of the computing device 102 include a laptop computer, a desktop computer, a server system, a smart phone, and a tablet. Examples of the display device 104 include a monitor, a television, an LCD display, and a projection system. In some examples, the computing device 102 includes the display device 104, rather than being separate devices as shown in FIG. 1. The input/output 106 can provide a wired or a wireless communication path for the computing device to communicate with external devices, such as the display device 104. Examples of the input/output 106 include a wireless transceiver, a serial port, a HDMI port, a USB port, and an Ethernet port.

The computing device 102 can also include a processor 108, a memory 110, and a bus 112. In some examples, some or all of the components shown in FIG. 1 can be integrated into a single structure, such as a single housing. In other examples, some or all of the components shown in FIG. 1 can be distributed (e.g., in separate housings) and in communication with each other.

The processor 108 can execute one or more operations for facilitating even take-up carpet design and generate one or more user interfaces for display by the display device 104. The processor 108 can execute instructions stored in the memory 110 to perform the operations. The processor 108 can include one processing device or multiple processing devices. Examples of the processor 108 include a Field-Programmable Gate Array ("FPGA"), an application-specific integrated circuit ("ASIC"), and a microprocessor.

The processor 108 can be communicatively coupled to the memory 110 via the bus 112. The memory 110, which may be a non-volatile memory, can include any type of memory device that retains stored information when powered off. Examples of the memory 110 include electrically erasable and programmable read-only memory ("EEPROM"), flash memory, or any other type of non-volatile memory. At least some of the memory 110 can include a medium from which the processor 108 can read instructions. A computer-readable medium can include electronic, optical, magnetic, or other non-transitory storage devices capable of providing the processor 108 with computer-readable instructions or other program code. Examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

The memory 110 can include instructions that form a pattern design engine 114 that, when executed by the processor 108, cause the computing device 102 to perform one or more operations for facilitating even take-up carpet design.

Figure 2:
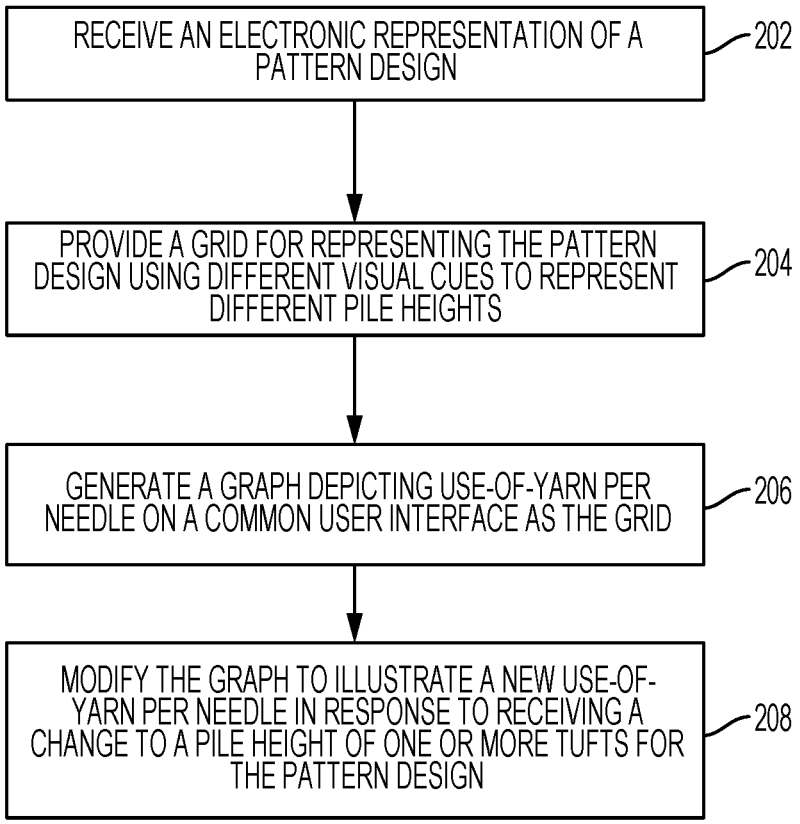
FIG. 2 is a flow chart of a process for facilitating even take-up carpet or other textile design according to some examples of the present disclosure.

FIG. 2 depicts a flow chart of a process for facilitating even take-up carpet or other textile design according to one aspect. The process of FIG. 2 is described with reference to the system 100 of FIG. 1, but other systems or devices, with hardware, software, or both, can be used instead.

In block 202, the computing device 102 receives an electronic representation of a pattern design. The pattern design can be coded instructions for controlling a carpet tufting operation. The pattern design can include a pile height per tuft of the design. The pattern design can be received by the computing device 102 from one or more user inputs through an input device and on a graphical illustration displayed on the display device 104. For example, the computing device 102 can receive a designation of a pile height for at least some tuft markers of a grid shown on the display device as a selection of a value from available pile height values for the operation. In other examples, the pattern design can be received by the computing device 102 as a file from a separate computing system over a network, such as the Internet, or from a storage device, such as an optical disc or a flash drive, that can be coupled, or inserted in, to the computing device 102.

In block 204, the computing device 102 provides a grid for display by the display device 104. The grid represents the pattern design using different visual cues to represent different pile heights. The grid can include columns and rows of tuft markers. Each tuft marker can correspond to a stitch of a tufting operation. Each column of tuft markers can be associated with a needle among multiple needles to be used in the tufting operation. The visual cues can include different colors that represent different pile-height values. In other examples, dashed or patterned cues are used to represent different pile-height values.

In block 206, the computing device 102 generates a graph that depicts use-of-yarn per needle on a common user interface as the grid. The graph may also depict a threshold that indicates a desired yarn-use across multiple needles for the tufting operation. The threshold may be a tolerance range for an acceptable deviation in yarn use across multiple needles for the tufting operation. The common user interface can include an interface that is displayable on the display device 104 such that the grid and the graph can be viewed at the same time on the display device 104.

In block 208, the computing device 102 modifies the graph to illustrate a new use-of-yarn per needle in response to receiving a change to a pile height of one or more tufts for the pattern design. The new use-of-yarn per needle can account for the change to the pile height in real time with respect to the change to the grid being made. The use-of-yarn per needle can predict an amount of yarn necessary for each needle to implement the pattern design through the carpet tufting operation.

Figure 3:
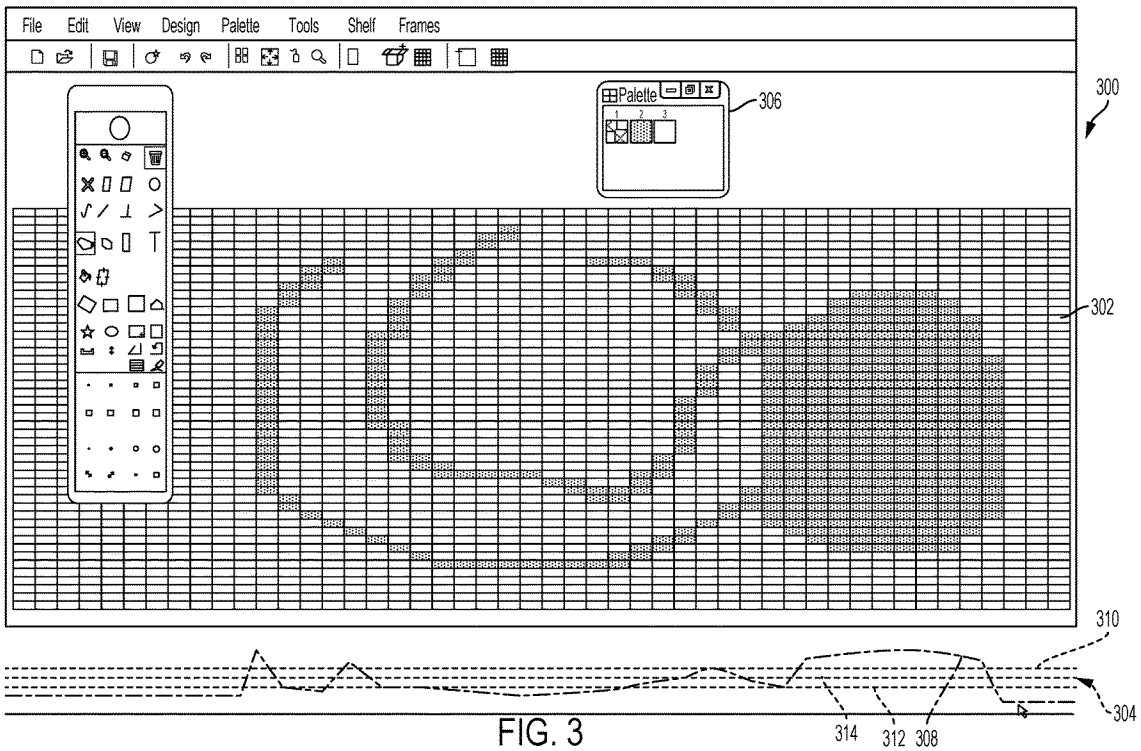
FIG. 3 is a user interface displayed on a display device according to one example of the present disclosure.

FIG. 3 is an example of a user interface 300 according to one aspect. The user interface 300 may be generated by the computing device 102 and viewable on the display device 104 of FIG. 1, or shown via other systems.

The user interface 300 depicts a grid 302 and a graph 304 that are viewable at the same time on a common interface. The grid 302 includes rows and columns of tuft markers. Each tuft marker can correspond to a stitch of a tufting operation. Each column can correspond to one needle among multiple needles that are used in the tufting operation. Commands can be received from an input device that designates the pile height of a tuft marker. In some examples, the grid can be pre-populated with a default pile height for all tuft markers and one or more other pile heights can be designated to certain tuft markers as a designer is working on the pattern design.

For example, in FIG. 3 there is shown a menu 306 with three pile height options. The different pile height options can be selected through user input and then, in response to further user input, the selected tuft height can be applied to one or more tuft markers. The different pile height options can be represented by different colors or other visual cues. When a tuft marker is assigned a particular pile height, that tuft marker can reflect the color or other visual cue of the particular pile height. Although three pile-height options are shown in FIG. 3, there can be any number of pile height options that each correspond to a particular pile height.

Represented on the graph 304 is the use-of-yarn per needle for a tufting operation. The portion of the graph 304 that is in-line with a particular column of the grid 302 can be linked to that needle and represent the use-of-yarn for the needle associated with that particular column of the grid 302. A use line 308 on the graph 304 can show the relative use-of-yarn among the needles associated with the columns. The graph 304 allows a designer to be aware of the impact that the pattern being designed has on use-of-yarn for a particular operation. Included in the graph 304 of FIG. 3 is a threshold range, represented by an upper bound line 310 and a lower bound line 312, within which it may be desirable to have the use line 308 positioned for all needles to result in a desired use-of-yarn per needle. In some embodiments, an optimal use line 314 is provided between the upper bound line 310 and the lower bound line 312 to indicate the ideal yarn usage, with the upper bound line 310 and the lower bound line 312 representing acceptable deviations from the optimal use line 314. In such embodiments, the designer can strive to create a tuft height design whereby the use line 308 overlies the optimal use line 314.

In the example shown in FIG. 3, portions of the use line 308 is within the threshold range and other portions of the use line 308 are not within the threshold range. The designer can be encouraged to change the design to cause the use line 308 to be flatter and within the threshold range, such that there is an even take-up for the needles in the tufting operation. In response to changes to the pile height of one or more tuft markers on the grid 302, the graph 304 can update substantially contemporaneously with the changes to show the use-of yarn per needle. The pattern designer can have real-time updates as to the use-of-yarn per needle for a particular tuft height pattern design.

Figure 4:
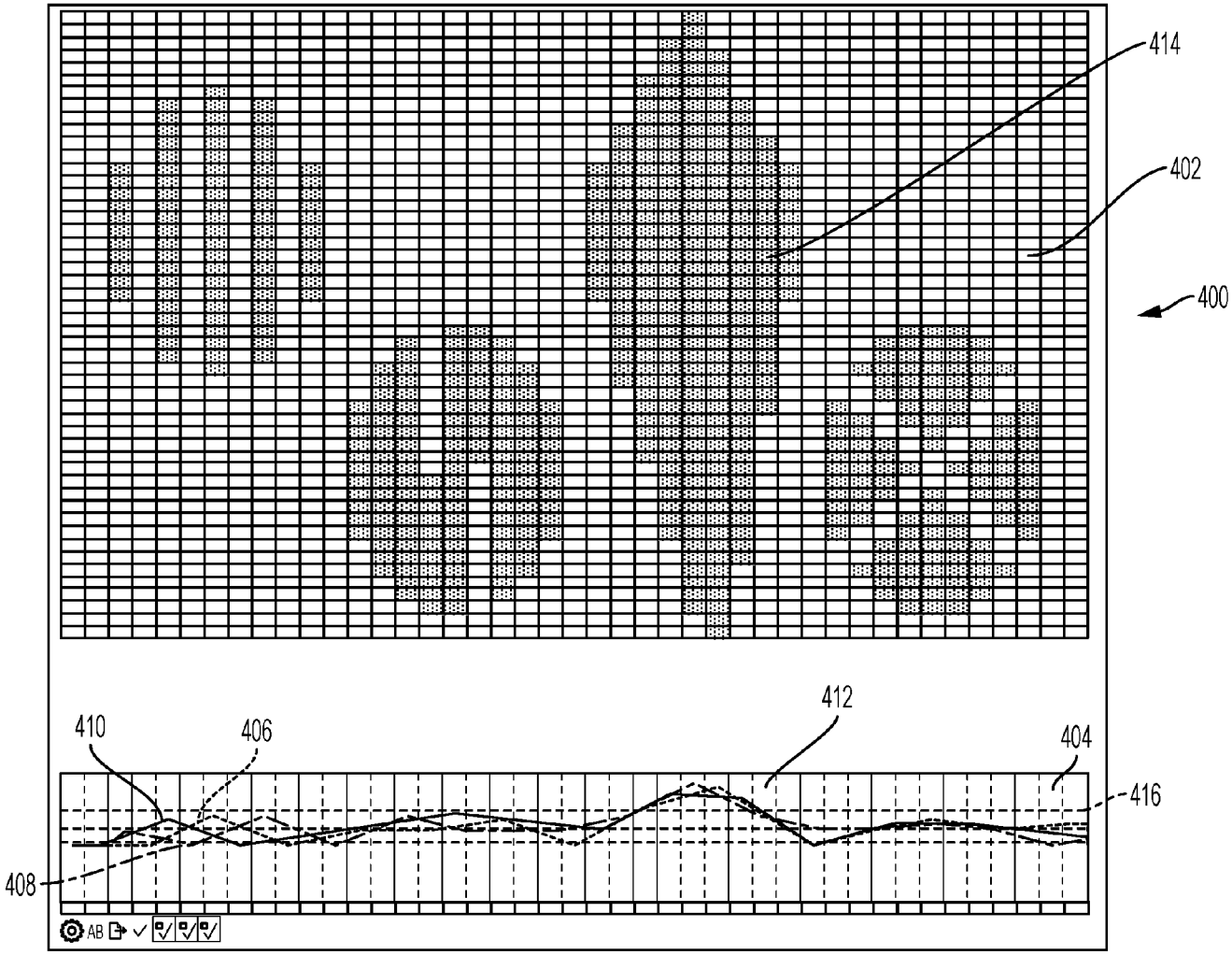
FIG. 4 is a user interface displayed on a display device according to another example of the present disclosure.

FIG. 4 is a user interface 400 according to another example of the present disclosure. The user interface 400 may be generated by the computing device 102 and viewable on the display device 104 of FIG. 1, or shown via other systems.

The user interface 400 shows a grid 402 with a pattern design and a graph 404 showing yarn use per needle on a common interface, similar to the user interface 300 of FIG. 3. The dark portions of the grid 402 represent tufts with high pile heights and the white or lighter portions of the grid 402 represent tufts with low pile heights. The graph 404, however, shows three different use lines 406, 408, 410 that represent use-of-yarn for different colors of yarn for each needle. A designer may include in the pattern design a designation of the color of yarn for each tuft marker. The use lines 406, 408, 410 can be represented with different colors or other line-specific visual cues, but the colors of the use lines 406, 408, 410 may not necessarily represent the color of yarns used in the tufting operation.

And each color of yarn is not necessarily used for each needle. For example, the left-most column of the grid 402 is associated with yarn of a first color represented by use line 406. Another column, however, may be associated with yarn of all three colors represented by the use lines 406, 408, 410. At portion 412 of the graph 404, for example, the part 414 of the pattern of the grid 402 is associated with a very high usage of all three colors as the use lines 406, 408, 410 of all three colors is higher than other parts of the lines and is outside the threshold range 416 of the graph 404.

The visual cues represented in the graph 404 can help a pattern designer create a pattern design so that an even take-up, or close to an even take-up, occurs for every yarn color used in the tufting operation. In other words, the same color of yarn has the same usage such that, for example, all of the blue yarn packages would be identical to all of the other blue yarn packages, all of the yellow yarn packages would be identical to all of the other yellow yarn packages, etc. This can help simplify the yarn package preparation process and significantly reduce the cost of unused yarn per needle for the tufting operation.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A method, comprising:

receiving an electronic representation of a pattern design for controlling a carpet tufting operation, the pattern design including a pile height per tuft;

providing a grid for representing the pattern design using different visual cues to represent different pile heights;

generating, by a processor executing a pattern design engine, a graph depicting use-of-yarn per needle for the carpet tufting operation, the grid and the graph being on a common user interface and viewable at the same time on a display device; and responsive to receiving a change to a pile height of one or more tufts for the pattern design on the grid, modifying the graph to illustrate a new use-of-yarn per needle that accounts for the change.

2. The method of claim 1, wherein the different visual cues are different colors to represent the different pile heights.

3. The method of claim 1, wherein the graph further depicts a threshold indicative of a desired yarn-use across multiple needles for the carpet tufting operation.

4. The method of claim 3, wherein the threshold is a tolerance range associated with an acceptable deviation in yarn use across the multiple needles for the carpet tufting operation.

5. The method of claim 1, wherein the grid includes a plurality of columns, and a plurality of rows, of tuft markers, each column of the plurality of columns being associated with a needle among a plurality of needles for the carpet tufting operation, each tuft marker representing a planned stitch by the associated needle.

6. The method of claim 5, wherein receiving the electronic representation of the pattern design for controlling the carpet tufting operation includes receiving a designation, for at least some of the tuft markers selected from the grid, of the pile height as a selection from a plurality of available pile heights.

7. The method of claim 5, wherein a portion of the graph is positioned with respect to a linked column and visually represents yarn use for the needle associated with the linked column.

8. The method of claim 1, wherein the use-of-yarn per needle is predictive of an amount of yarn necessary for each needle of a plurality of needles to implement the pattern design through the carpet tufting operation.

9. The method of claim 1, wherein the graph includes a plurality of use lines that represent the use-of-yarn per needle for different colors of yarn.

10. A non-transitory, computer-readable medium having program instructions that are executable by a processor for performing operations, the operations comprising:

receiving an electronic representation of a pattern design for controlling a carpet tufting operation, the pattern design including a pile height per tuft;

providing a grid for representing the pattern design using different visual cues to represent different pile heights;

generating a graph depicting use-of-yarn per needle for the carpet tufting operation, the grid and the graph being on a common user interface and viewable at the same time on a display device; and responsive to receiving a change to a pile height of one or more tufts for the pattern design on the grid, modifying the graph to illustrate a new use-of-yarn per needle that accounts for the change.

11. The non-transitory, computer-readable medium of claim 10, wherein the different visual cues are different colors to represent the different pile heights.

12. The non-transitory, computer-readable medium of claim 10, wherein the graph further depicts a threshold indicative of a desired yarn-use across multiple needles for the carpet tufting operation.

13. The non-transitory, computer-readable medium of claim 12, wherein the threshold is a tolerance range associated with an acceptable deviation in yarn use across the multiple needles for the carpet tufting operation.

14. The non-transitory, computer-readable medium of claim 10, wherein the grid includes a plurality of columns, and a plurality of rows, of tuft markers, each column of the plurality of columns being associated with a needle among a plurality of needles for the carpet tufting operation, each tuft marker representing a planned stitch by the associated needle.

15. The non-transitory, computer-readable medium of claim 14, wherein receiving the electronic representation of the pattern design for controlling the carpet tufting operation includes receiving a designation, for at least some of the tuft markers selected from the grid, of the pile height as a selection from a plurality of available pile heights.

16. The non-transitory, computer-readable medium of claim 14, wherein a portion of the graph is positioned with respect to a linked column and visually represents yarn use for the needle associated with the linked column.

17. The non-transitory, computer-readable medium of claim 10, wherein the use-of-yarn per needle is predictive of an amount of yarn necessary for each needle of a plurality of needles to implement the pattern design through the carpet tufting operation.

18. The non-transitory, computer-readable medium of claim 10, wherein the graph includes a plurality of use lines that represent the use-of-yarn per needle for different colors of yarn.

19. A system, comprising:

a display device configured to output a common user interface;

a computing device communicatively coupled to the display device, the computing device comprising a processor and a non-transitory, computer-readable memory having instructions that are executable by the processor to cause the computing device to perform operations, the operations comprising:

receiving an electronic representation of a pattern design for controlling a carpet tufting operation, the pattern design including a pile height per tuft;

providing a grid for representing the pattern design using different visual cues to represent different pile heights;

generating a graph depicting use-of-yarn per needle for the carpet tufting operation and outputting the grid and the graph for display by the display device on the common user interface such that the grid and the graph are viewable at the same time on the display device; and responsive to receiving a change to a pile height of one or more tufts for the pattern design on the grid, modifying the graph to illustrate a new use-of-yarn per needle that accounts for the change.

20. The system of claim 19, wherein the display device is separate from the computing device, wherein the graph further depicts a threshold indicative of a desired yarn-use across multiple needles for the carpet tufting operation, the threshold being a tolerance range associated with an acceptable deviation in yarn use across the multiple needles for the carpet tufting operation, wherein the grid includes a plurality of columns, and a plurality of rows, of tuft markers, each column of the plurality of columns being associated with a needle among a plurality of needles for the carpet tufting operation, each tuft marker representing a planned stitch by the associated needle, wherein a portion of the graph is positioned with respect to a linked column and visually represents yarn use for the needle associated with the linked column, and wherein the use-of-yarn per needle is predictive of an amount of yarn necessary for each needle of the plurality of needles to implement the pattern design through the carpet tufting operation.

* * * * *